US008616133B2

(12) United States Patent
Theurer et al.

(10) Patent No.: US 8,616,133 B2
(45) Date of Patent: Dec. 31, 2013

(54) TAMPING MACHINE WITH AN ADDITIONAL LIFTING DEVICE

(75) Inventors: Josef Theurer, Vienna (AT); Alfred Schoenaigner, Linz (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 13/581,072

(22) PCT Filed: Feb. 4, 2011

(86) PCT No.: PCT/EP2011/000537

§ 371 (c)(1),
(2), (4) Date: Aug. 24, 2012

(87) PCT Pub. No.: WO2011/107201

PCT Pub. Date: Sep. 9, 2011

(65) Prior Publication Data

US 2012/0318162 A1 Dec. 20, 2012

(30) Foreign Application Priority Data

Mar. 1, 2010 (AT) ..... 310/2010

(51) Int. Cl.
*E01B 27/17* (2006.01)

(52) U.S. Cl.
USPC ..... 104/7.1; 104/7.2; 104/12

(58) Field of Classification Search
USPC ..... 104/2, 7.1, 7.2, 10, 12
See application file for complete search history.

(56) References Cited

U.S. PATENT DOCUMENTS

| | | | | |
|---|---|---|---|---|
| 5,299,505 | A * | 4/1994 | Theurer et al. | 104/7.2 |
| 5,343,810 | A * | 9/1994 | Theurer | 104/12 |
| 5,379,700 | A * | 1/1995 | Theurer | 104/7.2 |
| 5,515,788 | A * | 5/1996 | Theurer et al. | 104/12 |
| 6,453,822 | B2 * | 9/2002 | Theurer et al. | 104/12 |
| 6,546,876 | B2 * | 4/2003 | Theurer et al. | 104/7.2 |
| 6,705,232 | B2 * | 3/2004 | Theurer et al. | 104/12 |
| 2001/0027732 | A1 * | 10/2001 | Theurer et al. | 104/12 |
| 2012/0318162 | A1 * | 12/2012 | Theurer et al. | 104/7.1 |

FOREIGN PATENT DOCUMENTS

| | | |
|---|---|---|
| DE | 23 05 421 | 8/1974 |
| DE | 43 07 862 | 9/1993 |
| EP | 1 143 069 | 10/2001 |
| EP | 1 162 310 | 12/2001 |

OTHER PUBLICATIONS

International Search Report of PCT/EP2011/000537, date of mailing Jun. 6, 2011.

* cited by examiner

*Primary Examiner* — Jason C Smith
(74) *Attorney, Agent, or Firm* — Collard & Roe, P.C.

(57) ABSTRACT

A tamping machine for tamping a track is equipped with a track lifting unit, positioned immediately in front of a tamping unit, and an auxiliary lifting device (19) designed for lifting a branch rail (20) of a switch branching off the main track. The auxiliary lifting device (19) is fastened to a beam (21) extending perpendicularly to a longitudinal direction of the machine and has a lifting tool (27) designed to be applied to a rail head (26). Two disk-shaped thrust rollers (32), spaced from one another in the longitudinal direction of the machine and rotatable in a common plane of rotation (33), for application to a first side face (34) of the rail head (26) are connected to the auxiliary lifting device (19). A flanged roller (36) is provided for application to a second side face (35) of the rail head (26) and for resting the auxiliary lifting device (19) on the latter. The auxiliary lifting device (19) is pivotable relative to the beam (21) about an axis (42) by means of a drive (41).

7 Claims, 2 Drawing Sheets

Figure 4:
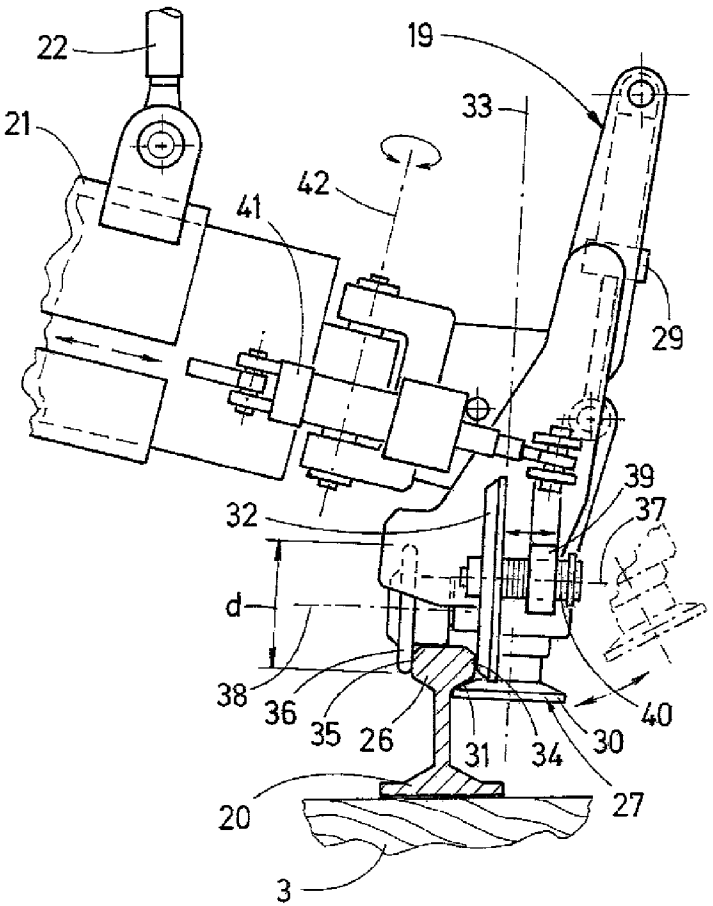

Fig. 1
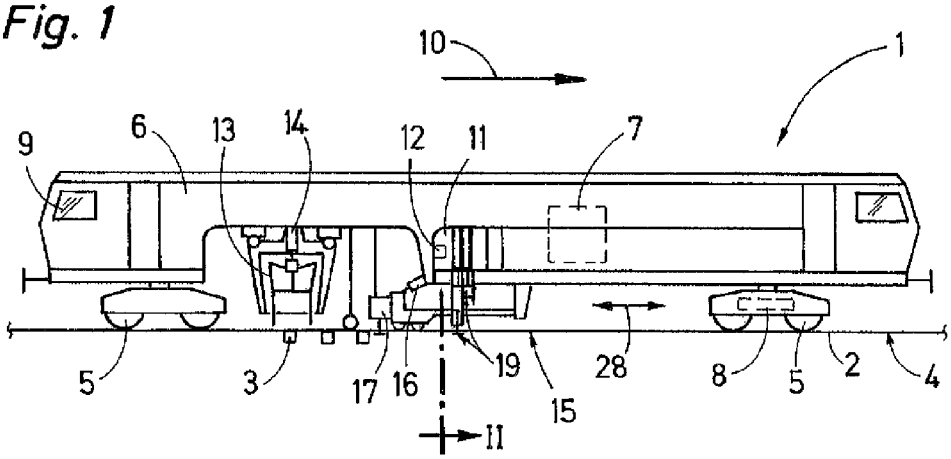
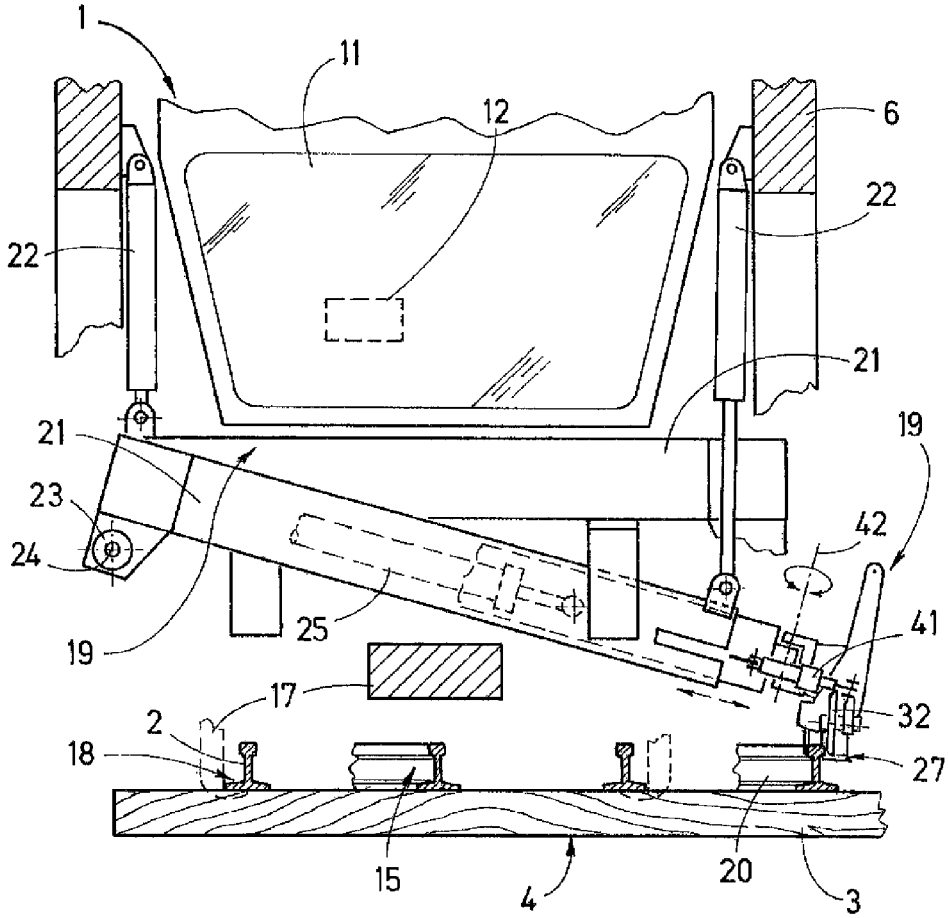
Fig. 2

TAMPING MACHINE WITH AN ADDITIONAL LIFTING DEVICE

CROSS REFERENCE TO RELATED APPLICATIONS

This application is the National Stage of PCT/EP2011/000537 filed on Feb. 4, 2011, which claims priority under 35 U.S.C. §119 of Austrian Application No. A 310/2010 filed on Mar. 1, 2010, the disclosure of which is incorporated by reference. The international application under PCT article 21(2) was not published in English.

The invention relates to a tamping machine for tamping a track according to the introductory part of claim 1.

Tamping machines of this type are already known, for example, from EP-A 1 143 069 and are suited not only for the track tamping of so-called plain line sections, but also especially for tamping in switch areas. During this—parallel to the lifting of the main track by means of a track lifting unit provided in immediate proximity to the tamping unit—the branching rail line is also lifted synchronously with the aid of an auxiliary lifting device rolling on the same via a double-flanged roller. To that end, the auxiliary lifting device comprises a lifting tool, fastened to a beam and adjustable by means of drives in the transverse direction of the track as well as vertically, which can be applied to a rail head of the branching rail and stays in engagement with the same while the tamping machine moves forward continuously in the working direction. When passing through the switch, however, problems may arise in some places, or—due to the position of certain switch components—it may be necessary to temporarily detach the auxiliary lifting device from the rail head.

It is the object of the present invention to provide a tamping machine of the type mentioned at the beginning, with which it is possible for the auxiliary lifting device to be in uninterrupted contact with the switch.

According to the invention, this object is achieved with a tamping machine of the specified kind with the features cited in the characterizing part of claim 1.

An auxiliary lifting device, designed in this manner, of a tamping machine is distinguished by markedly improved gripping security due to the two thrust rollers spaced from one another in the longitudinal direction of the machine, while at the same time also a greater clamping force can thus be reliably transferred to the rail head. In an advantageous way, this brings about increased safety from slipping when the rail of the branch track is raised, and thus work safety in general is heightened. Furthermore, due to the two thrust rollers, it is no longer necessary to design the flanged roller supporting the auxiliary lifting device as a double flanged roller, like before; an embodiment having a single flange, which is now possible, allows the device to remain resting on the rail while passing through the switch. Finally, the possibility of pivoting the auxiliary lifting device relative to the beam offers the additional special advantage of problem-free adaptation to the position of the branching rail running at an angle to the main track, which significantly facilitates particularly the procedure of on-tracking the auxiliary lifting device in the switch.

Additional advantages of the invention become apparent from the dependent claims and the drawing description.

The invention will be described in more detail below with reference to an embodiment represented in the drawing in which FIG. 1 shows a greatly simplified side view of a tamping machine designed according to the invention, FIG. 2 shows a section view according to arrow II in FIG. 1, and FIGS. 3 and 4 each show an enlarged detail view, in the transverse and longitudinal direction of the track, of the auxiliary lifting device according to the invention.

A tamping machine 1, represented merely schematically in FIG. 1, for tamping a track 4 formed of rails 2 and sleepers 3 has a machine frame 6 supported on on-track undercarriages 5. With the aid of a motor 7 as well as a motive drive 8 and driver's cabs 9, the tamping machine 1 is mobile in a working direction 10 as indicated by an arrow. A control device 12 located in a work cabin 11 serves to activate and control various working units of the machine 1.

The tamping machine 1 is equipped with a tamping unit 13, fastened to the machine frame 6, which is vertically and transversely adjustable by means of drives 14 and designed for tamping the track 4—and, during this, particularly for operation in switches 15. Provided between the on-track undercarriages 5 immediately in front of the tamping unit 13, with regard to the working direction 10, is a track lifting unit 17 vertically and transversely adjustable by drives 16 for levelling and lining a main track 18 (FIG. 2) of the track 4 on which the on-track undercarriages 5 run.

As visible now in more detail in FIG. 2, a respective auxiliary lifting device 19 is associated with the track lifting unit 17 per longitudinal side of the machine 1 and designed for lifting a branch rail 20 of the switch 15, branching off the main track 18. The auxiliary lifting device 19 is fastened to a beam 21, extending perpendicularly to a longitudinal direction 28 of the machine (FIG. 1), which is articulatedly connected to the machine frame 6 by means of a joint 23 having an axis 24 extending in the longitudinal direction 28 of the machine and is vertically adjustable or pivotable by means of a drive 22. By means of a further drive 25, the beam 21 is designed to be elongatable perpendicularly to the longitudinal direction 28 of the machine for adjustment of the auxiliary lifting device 19 which is positioned at the end of the beam 21 spaced from the joint 23. Additionally, the auxiliary lifting device 19 is pivotable relative to the beam 21 about an axis 42 with the aid of a drive 41.

Figure 3:
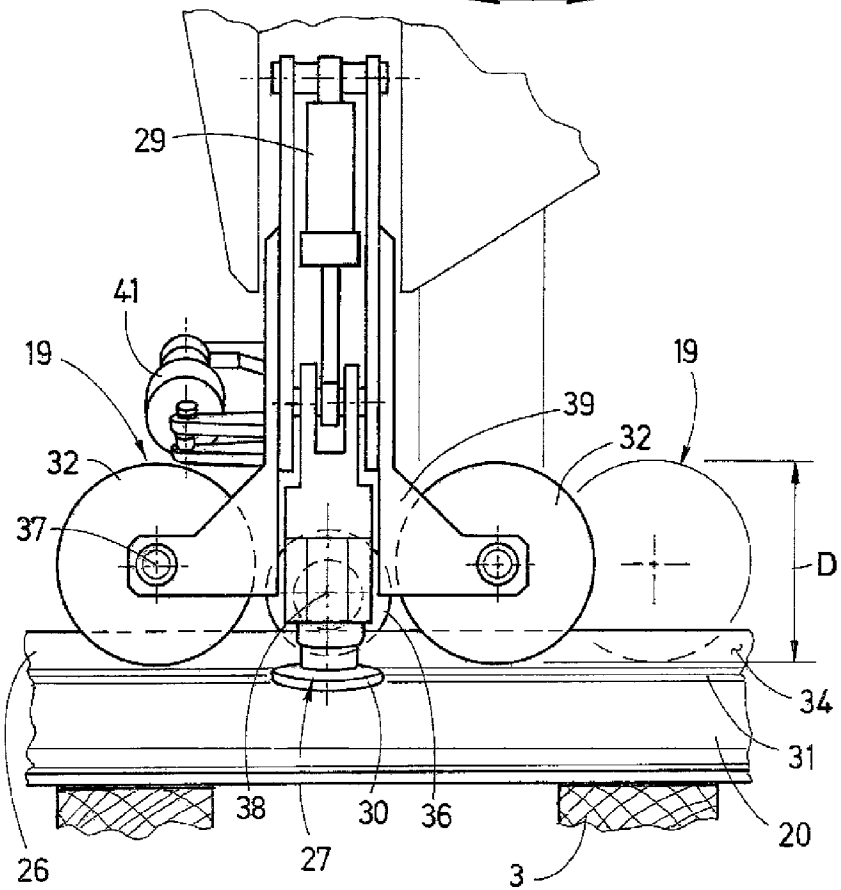

As can be seen in more detail in FIGS. 3 and 4, the auxiliary lifting device 19 is equipped with a lifting tool 27 designed to be applied to a rail head 26 of the branch rail 20. This lifting tool 27 consists essentially of a rotatable lifting roller 30 which is designed for swivelling in to an underside 31 of the rail head 26 by means of drive 29. Additionally connected to the auxiliary lifting device 19 are two disk-shaped thrust rollers 32, spaced from one another in the longitudinal direction 28 of the machine, which are rotatable in a common plane of rotation 33 and designed to be applied to a first side face 34 of the rail head 26. Provided for application to an oppositely-positioned second side face 35 of the rail head 26 is a flanged roller 36 which serves for resting the auxiliary lifting device 19 on the branch rail 20 and continuously rolls on the latter during working operations.

The two thrust rollers 32 and the flanged roller 36 have axes of rotation 37 and 38, respectively, which are aligned parallel to one another. As seen in the direction of said axes of rotation 37, 38, the flanged roller 36 (or the flange thereof) and the lifting tool 27 are arranged opposite one another with respect to the rail head 26. In this, the axes of rotation 37 of the thrust rollers 32 are positioned higher, with regard to a vertical, than the axis of rotation 38 of the flanged roller 36. A diameter D of the thrust rollers 32 is configured to be at least 40% larger than a diameter d of the flanged roller 36.

Each thrust roller 32 is connected to the auxiliary lifting device 19 by means of a roller mount 39 and designed for displacement with respect to the same in the direction of the axis of rotation 37 (see small arrow in FIG. 4). To that end, for example, an axle shaft 40—forming the axis of rotation 37—of the thrust rollers 32 can be designed for being fixed to the roller mount 39 in different positions. In this manner it is possible at the start of operations to adapt the auxiliary lifting device 19 quickly and simply to rail heads 26 of different width dimensions, such as occurs in operational practice. At the same time, the design of the auxiliary lifting device 19 being pivotable about the axis 42 relative to the beam 21 makes it possible to match the position of the plane of rotation 33 of the thrust rollers 32 to the position—extending at an angle to the main track 18—of the branch rail 20 of the switch 15, particularly during on-tracking of the auxiliary lifting device 19 at the start of working operations. In an advantageous manner, this adjustment for avoiding on-tracking faults can be carried out by remote control with the aid of the drive 14 by working personnel situated in the work cabin 11.

The invention claimed is:

1. A tamping machine for tamping a track, comprising:

a track lifting unit;

a plurality of drives configured to vertically adjust the track lifting unit;

a plurality of on-track undercarriages configured to support the tamping machine;

a tamping unit wherein said tamping unit and said track lifting unit are positioned between the on-track undercarriages, wherein said track lifting unit is positioned in front of said tamping unit with regard to a working direction of the machine;

wherein the track lifting unit is configured to level and line a main track on which the on-track undercarriages are travelling;

a beam, extending perpendicular to a longitudinal direction of the machine;

an auxiliary lifting device fastened to said beam and designed for lifting a branch rail of a switch branching off the main track wherein said auxiliary lifting device comprises:

a lifting tool designed to be applied to a rail head, comprising:

two disk-shaped thrust rollers, spaced from one another in the longitudinal direction of the machine and rotatable in a common plane of rotation, for application to a first side face of the rail head and which are connected to the auxiliary lifting device;

a flanged roller is provided for application to a second side face of the rail head and for resting the auxiliary lifting device on said rail head;

wherein the auxiliary lifting device is pivotable relative to the beam about an axis which is substantially perpendicular to a longitudinal direction of the machine by means of a drive.

2. The tamping machine according to claim 1, wherein axes of rotation of the two thrust rollers and of the flanged roller are arranged parallel to one another.

3. The tamping machine according to claim 2, wherein the flanged roller and the lifting tool are arranged opposite one another in the direction of the axes of rotation with regard to the rail head.

4. The tamping machine according to claim 2, wherein the axes of rotation of the thrust rollers are positioned higher with regard to a vertical than the axis of rotation of the flanged roller.

5. The tamping machine according to claim 4, wherein a diameter (D) of the thrust rollers is configured to be at least 40% larger than a diameter (d) of the flanged roller.

6. The tamping machine according to claim 2, wherein the thrust roller is displaceable with respect to a roller mount, connected to the auxiliary lifting device, in the direction of the axis of rotation and designed to be fixed in different positions.

7. The tamping machine according to claim 1, wherein said track lifting unit is positioned immediately in front of said tamping unit with regard to a working direction of the machine.

* * * * *